United States Patent [19]

Zink et al.

[11] 4,227,872

[45] Oct. 14, 1980

[54] APPARATUS FOR SUPPLYING ALTERNATE GASES TO STEAM INJECTION MEANS ON A FLARE STACK

[75] Inventors: John S. Zink; Robert D. Reed, both of Tulsa, Okla.

[73] Assignee: John Zink Company, Tulsa, Okla.

[21] Appl. No.: 910,446

[22] Filed: May 30, 1978

Related U.S. Application Data

[63] Continuation-in-part of Ser. No. 739,606, Nov. 8, 1976, abandoned.

[51] Int. Cl.[3] ..... F23H 5/24

[52] U.S. Cl. ..... 431/90; 431/5; 431/12; 431/202

[58] Field of Search ..... 431/90, 4, 5, 8, 202, 431/12

[56] References Cited

U.S. PATENT DOCUMENTS

| | | | |
|---|---|---|---|
| 3,262,485 | 7/1966 | Page et al. | 158/28 |
| 3,771,940 | 11/1973 | Stranahan et al. | 431/90 X |
| 3,887,324 | 6/1975 | Reed et al. | 431/5 |
| 3,917,796 | 11/1975 | Ebeling | 431/5 X |
| 3,985,494 | 10/1976 | Childree | 431/202 X |
| 3,994,671 | 11/1976 | Straitz | 431/5 X |

*Primary Examiner*—Carroll B. Dority, Jr.

*Assistant Examiner*—Randall L. Green

*Attorney, Agent, or Firm*—Head & Johnson

[57] ABSTRACT

In a flare stack system for the flaring of waste gases, in which the flare stack is equipped with steam injection parts, such as nozzles or manifolds, adjacent the flame zone at the outlet end of the stack, means are provided for alternate injection of air from a blower, or live steam, through the steam injection parts. The alternate flow is controlled by two pneumatically controlled valves, one in the blower air line, and the other in the steam line, such that when one valve is closed, the other is open, and vice versa. The objective of the alternate supply of air and steam is for the purpose of cooling the steam injection parts when the full flow of steam is not required, because there is no waste gas flow or only a minimal gas flow. In that case, the heat of the maintenance gas flow may be sufficient to injure the steam injection parts, which must be cooled by passage of a gas through them. When the ambient temperature is below freezing a small flow of steam is unsatisfactory since it readily condenses to liquid, and can form ice over the parts of the main gas flow outlets, etc. In this condition, air at low pressure is used to cool the parts and when the gas flow is large, the two valves are switched, the air is cut off and the full steam flow is initiated.

11 Claims, 2 Drawing Figures

APPARATUS FOR SUPPLYING ALTERNATE GASES TO STEAM INJECTION MEANS ON A FLARE STACK

CROSS REFERENCE TO RELATED APPLICATION

This Application is a Continuation-in-Part of our copending application, Ser. No. 739,606, filed Nov. 8, 1976, now abandoned, the title of which is: COOLANT FOR SMOKELESS FLARE STEAM INJECTION PARTS WHEN THE FLARE IS IN STAND-BY.

BACKGROUND OF THE INVENTION

This invention lies in the field of gas flaring systems. More particularly, it concerns flares in which waste gases are flared and in which steam is used for injection into the flame zone for the purpose of smokeless combustion of the gases.

Still more particularly, this invention is concerned with the protection of the steam injection parts from excessive heat due to the maintenance gas flow, when waste gases are not being flared.

The art of smokeless flare burning of smoke prone gases, through the injection of steam in the conventional manner, to the burning zone of the flare, is now well known. For the portion of the year when ambient temperature is higher than the freezing point of water there is little difficulty involved in flare operations. However, when the ambient temperature falls to or below freezing, there is considerable difficulty.

The difficulty arises because, for a very large percentage of the time, the flare is either in standby condition, for emergency flaring, or is discharging and burning gases at a minimal rate, which may be of the order of 1% of design flow capacity. This condition of gas burning, even though it is a small portion of the flare capacity, it is still productive of enough heat to very seriously damage the steam injection parts, unless there is constant flow of a coolant medium through and from the steam injection parts.

A typical coolant medium is steam, and when the weather is mild, cooling by steam flow is quite satisfactory. Although the quantity of steam flowing is quite small, because the cost of steam is so great, such flow is expensive. Also, in cold weather, a large portion of the steam condenses to water, to be sprayed at random over the critical flare discharge areas. At very low temperatures, ice forms in or near the flare discharge areas to partially or completely block the flared gas passages to the atmosphere. This can bring about a condition of extreme emergency in the process operations, where flare venting of emergency relieved gases demands instant and unobstructed gas flow to the atmosphere.

There is also another source of water which may ultimately freeze in and on the flare. This comes from the large capacity steam line from the source of steam, to a control point at the base of the flare. The steam line, which is typically hundreds of feet long, and is either at no flow or very small flow at the time the flare is on standby, is subject to heat loss despite insulation. At a time when the control means calls for steam, and flow to the flare from the control point begins, the flow is initially all the accumulated condensate, to be followed by steam, after the water is cleared out. Then there is additional water which has accumulated in low areas of the steam line, which flows as slugs, on arrival at the steam line up the flare. However water may be delivered to the flare, the freezing hazard is present and it demands solution in point of sources of water, at or near to the burning zone of the flare, when the weather can cause freezing of the water.

SUMMARY OF THE INVENTION

It is a primary object of this invention to provide a system for cooling the steam injection parts adjacent the burning zone in a flare stack during the periods when the flare stack is in standby condition, and there is only minimum flow of gas through the stack.

It is a further object of this invention to provide an alternate to the flow of steam for cooling the steam parts, which alternate flow is of a gas of similar specific heat per unit volume weight and not per unit volume, namely air.

It is a further object of this invention to provide a system which can supply air from a blower to pass through and cool the steam injection parts, at the outlet of a flare stack.

These and other objects are realized and the limitations of the prior art are overcome in this invention by providing two sources of gas that may be alternatively passed through the steam line, to the top of a flare stack, and through the manifold and nozzles through which steam is normally injected into the burning zone. Blower means are provided which force air through a conduit and through a remote-controlled valve, and through a series connected manual valve, into the steam line which passes up the flare stack to the burning zone. The steam line which is provided to carry live steam from a distant source to the steam line up the flare stack, and to the steam injection parts at the burning zone, passes through a steam separator which separates condensate from the steam. The steam then passes through a remote-controlled valve and to the steam line up the flare stack. The valve in the steam line and the valve in the air line are both connected to the same signal source but they operate in opposition, such that when the air valve is open the steam valve is closed, and vice versa.

Although the specific heat of steam is twice that of air, since one pound mol of air is almost twice the weight of one pound mol of steam, their cooling effect is substantially the same. Thus, air and steam can be substituted, one for the other, as a cooling medium through the steam parts that are exposed to the flame in the standby condition.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 2:
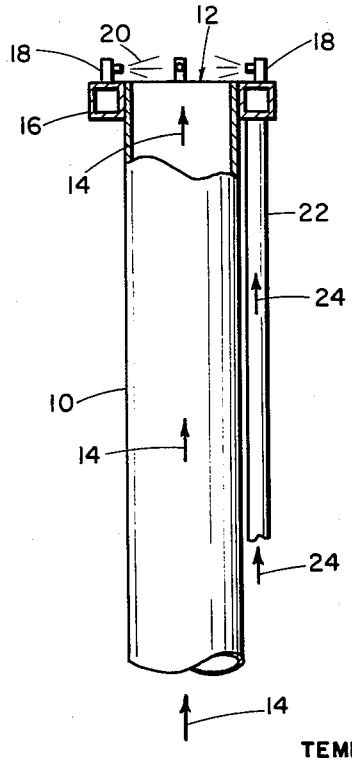
FIG. 2 illustrates the normal type of steam injection apparatus mounted at the top of a flare stack.

Referring now to the drawings, there is shown means for avoiding the unintentional delivery of liquid water to a steam actuated smokeless flare at any time. Since the use of steam as a coolant is significant, as a source of water, its use is undesirable not only because of its cost, but also because when the ambient temperature is below the freezing point, the condensation of the steam passing through the steam injection parts, produces water which may freeze and cause difficulty in the subsequent burning of the waste gases.

Figure 1:
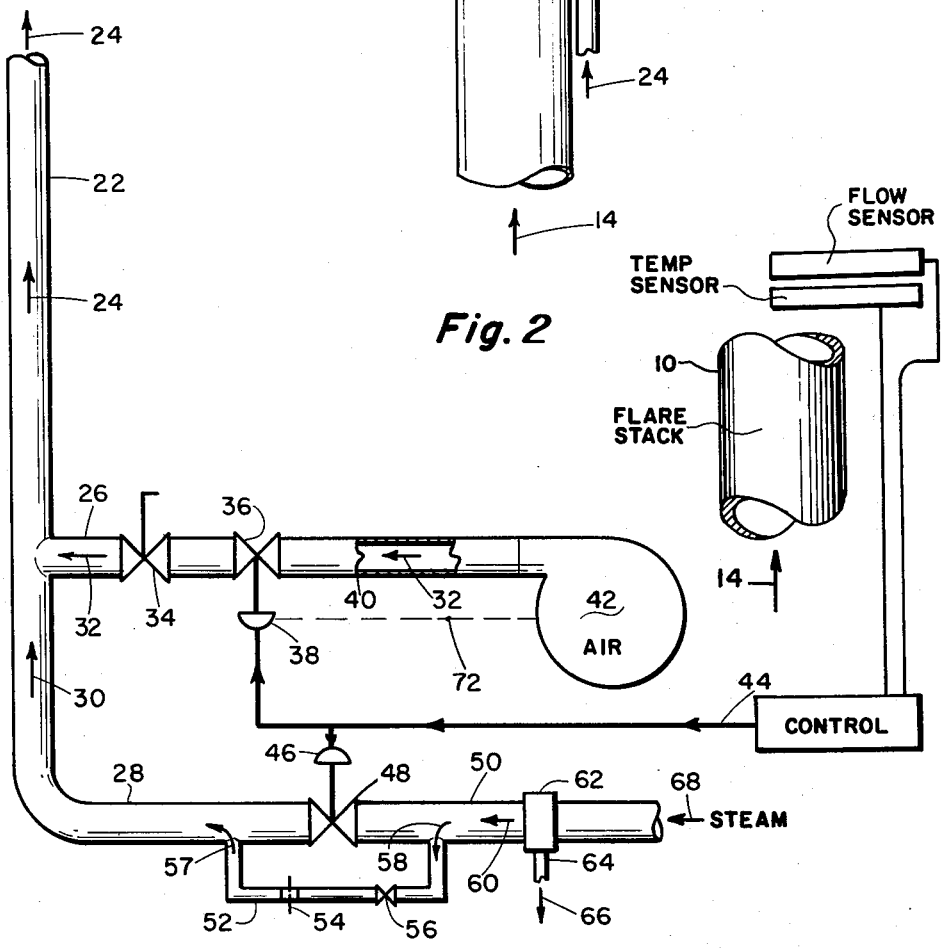
FIG. 1 shows the essential parts of the system.

FIG. 1 illustrates one embodiment of the system in which steam is applied through a steam line 50, in accordance with the arrow 68, for the purpose of injection into a steam injection apparatus 16, 18 on the top of a flare stack 10 shown in FIG. 2. The steam line includes a condensate trap 62 and condensed water outlet pipe 64, where any condensate carried by the steam 68 is separated in the form of water flow indicated by the arrow 66.

The steam flow 60 then proceeds through a conduit 50, through a remote-controlled valve 48, and through a pipe 28 to the base of the flare stack 10 and to steam riser pipe 22, which passes up along the side of the stack 10, as shown in FIG. 2, to the steam injection parts 16, 18 at the top of the flare stack. These steam injection parts comprise a circular manifold 16 which surrounds the flare stack at the top 12, a plurality of small diameter pipes 18 which rise up from the manifold 16, and which have radial openings or orifices, from which the steam sprays out radially across the combustion zone, immediately above the top 12 of the stack.

In FIG. 2 the waste gases 14 pass up through the flare stack 10, either as shown, or as in some cases through a spider arm burner, or similar device, to the flame zone. The steam jets 20 are at high velocity and are directed inwardly to the hot burning gases, which cause turbulence and mixing of the steam with the hot gases to provide the desired chemistry of smokeless burning.

The valves 36 and 48 have operating controls 38 and 46 respectively, which are connected by control leads 44 to a control means, not shown, but well known in the art. The control means may be pneumatic or electric, as is well known in the art. The two valves 36 and 48 are connected so that they are in opposition, one being closed when the other is open, and vice versa.

At the times when the flare is on standby, and the ambient temperature is below freezing, the blower 42 is operated, and air is supplied through open valve 36, up pipe 22 to the steam parts 16 and 18, providing cool air through the hot parts to prevent damage due to the heat of the flame.

In the event that air is not available, for any reason, it is necessary that there be substitute means for cooling the steam injection parts. Therefore, the cooling system must permit alternate selection of a cooling medium. Steam may be selected as the alternate medium, but any gaseous coolant flow would be equally good. In case steam is desired to provide the cooling effect through the steam injection parts, while the flare is on standby, instead of opening the valve 48 a bypass 52 is provided so that a small part of the steam 60 can go through the bypass 52, through a valve 56 and through a flow limiting orifice 54, and in accordance with arrow 57 flow back into the steam line 22, and up to the top of the flare stack.

When the ambient temperature is above freezing, of course, either air or steam can be used for standby. In one case, the valves 56 and 48 would be closed and the valve 36 would be open, and air would be supplied from the blower 42. In the other case, the valve 36 would be closed, or alternately the valve 34 can be closed, and the valve 56 opened, providing a maintenance flow of steam for purposes of cooling the parts 16 and 18, etc.

When the flow of waste gases is initiated, the control on 44 then opens valve 48 and closes 36 and permits a full flow of steam 60 through valve 48 and as arrow 24 to the injection parts 16 and 18, in the well known manner.

Since the steam pressure applied to line 50 is much greater than the pressure of the air supplied by the blower 42, it is important that the valve 36 (or 34) be closed whenever the steam valve 48 is open, otherwise part of the steam will be bypassed back through the blower causing serious damage.

What has been described is a system for providing a standby cooling gas through the steam injection parts in a flare stack, which uses steam injection for purposes of smokeless combustion, whenever the flare is on standby, and there is only a minimal flow of gases, whether waste gas or fuel gas supplied to the stack. When the ambient temperature is above freezing, any gas can be used such as either air or steam, since there is no problem of ice formation. If steam is available it may be used, on the other hand, air from a blower can be supplied at less cost, than can the steam, and so it may be desirable to use air at all times during the standby period. Of course, when the valve 36 is closed, the blower is shut off and the power required for the blower is thus saved. This is shown schematically by the dashed line 72.

In cases where the ambient temperature is below freezing, the preferred gas to use for cooling purposes is air, since in the use of blower-supplied air, there is no danger of carrying water to the region of the steam injection parts.

The use of air for cooling the steam injection part corrects for one source of water at the top of the flare stack. The other source of water due to the condensation of steam inside the steam supply line is preferably corrected by means of apparatus 62, which provides a separation or trap, for the condensate, and permits the dry steam to pass on as arrow 60 to the riser pipe 22 and to the stack.

Since the relative cooling effect of a given number of mols of steam and air is roughly the same, it is clear that economically it is preferable to use blower air for cooling the steam parts, than to use steam, under all conditions of ambient temperature. In such case, the bypass line 52 would not be needed nor would the valve 34 and the control would simply open valve 36 and close valve 48 when the flare stack is on standby and it would close valve 36 and open valve 48 when waste gases are flared and burned.

In the day-to-day operation of a smokeless flare, where steam is used for smoke suppression, the flare, on demand, must immediately accept, and burn, gas discharges which vary in volume from 100% of design discharge rate to less than 0.5% of design discharge volume. When the discharge rate for flammable gases exceeds a minor portion of gas discharge rate, there is delivery of steam to the steam injection parts for the cooling of them in their locations in or immediately adjacent to the flame produced as the vented gases burn.

Such steam-induced cooling is vitally necessary to avoid severe heat damage to the steam injection parts when there is flame at the flare discharge point, and without reference to the size of the flame produced. Since steam injection parts demand cooling when flame is present, and since venting at 0.5% of design (200-1 turn-down) does not cause steam injection under control, but does create appreciable flame at the flaring point, as a source of heat damage to injection parts, it has been common practice to add a by-pass around the steam control valve to assure small steam delivery to injection parts on a 24-hour basis via the normal steam supply system after the control valve.

The small steam delivery thus described suitably cools the injection parts when there is flame present as at 0.5 to 1% of design gas venting, or even more than 1% of design venting rate, as is practice-proven in hundreds of cases. But the small steam delivery is productive of an accessory problem in frigid weather when there is no gas venting, and this second problem is utterly severe. Due to cold weather, the small quantity of steam condenses when there is zero venting of gases to the flare and no flame is present at the flare discharge point. The condensed steam (water) spatters and freezes on flare parts, including the gas tube to the burning point, which may become covered with ice. Emergency venting of gases then becomes impossible, and the process facility is, totally, in danger of explosion because pressure-relief on process equipment (which is the main reason for the flare) is impossible.

Such freezing of smokeless flares is quite common in typical winters, for process plants in areas north of Latitude 45; is far from rare down to 40 North, and has been known to occur farther South.

The flare must not become inoperable at any time the process plant is in operation, in any area where there is freezing danger, as discussed. Therefore, while steam coolant for steam injection parts is quite suitable for Spring, Summer, and Fall, it is not at all suited to Winter-time operation. A coolant which is not subject to freezing is demanded for very small flare burning and periods when there is no burning at the flare.

Because of its physical characteristics, air, which cannot cause freezing, is admirably suited as a substitute for the steam coolant, and at low pressure for just-ample flow. However, steam is demanded for smoke suppression in the burning of large flow rates of smoke-prone gases as they are flared, and high steam pressure (up to 100# or more) is needed for the steam for injection to the burning zone from the identical parts which have been discharging the air coolant, and in a substantially instantaneous manner. Both flows are subject to automatic control for air or steam delivery sequence. This is to say that, at a time when coolant air is being delivered, if it becomes necessary to flare-burn smoke-prone gases, steam must immediately replace the air coolant under control as to quantity. The specification describes apparatus to perform this service and also to return to air coolant delivery when there is no longer necessity for gas venting at large flow rate, and there is no longer need for steam delivery.

A signal comes via 44 to 38 and 46 to cause closure of 36 and opening of 48. The signal to 38, removes motive power from 42, via 72, and flow of air 32 ceases, while steam begins to flow through opened 48 via 28 to 22. Meanwhile, 56 is closed. Because 36 is closed, steam must proceed via 22 to 16 and 18 for the required smoke suppression as long as there is operating signal via 44.

Automatically, and as the signal via 44 ceases, 38 causes opening of 36, and simultaneously (via 72) power is again applied to the motive source of 42, and air flow 32 begins via opened 36 and 26 to 22, while valve 48 is closed. The cooling air flow to 16 and 18 is thus automatically restored when there is no longer any need for steam. In the Spring, Summer, and Fall, when there is no danger of freezing, 56 is opened for passage of steam coolant via 28 and 22 to 16 and 18. But, in the Winter, 56 is closed, and only non-freezing air is used as coolant for 16, 18. In the Spring, Summer, and Fall, the valve 34, which can be for manual operation, is kept closed. But, in the Winter, 34 is kept open to permit passage of air coolant from 36 to 26 and 22 to 16 and 18.

The numeral 68 is for steam flow, as permitted, or required. Condensate (water) is typical of lines for saturated steam (which is typically used), and 62 is a trap means for condensate removal from the steam system as 66 from 64 to permit flow of dry steam as at 60.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

It is claimed:

1. In a flare stack system in which waste gas is flared on demand, and in which the flow rate of waste gases may vary from low flow rates to high flow rates of up to 100% of the design value of gas flow rate; and including steam injection means at the top of said flare stack comprising manifold means connected to a steam riser pipe, and plural injection nozzles connected to said manifold;

the improved apparatus comprising;

(a) low pressure air blower means, and first controllable air valve for providing controlled on-off flow of blower air to said steam riser pipe;

(b) steam line means and second controllable steam valve for providing controlled on-off flow of steam on demand to said steam riser pipe;

(c) control means for said air valve and steam valve for alternate flow of air or steam to said steam riser pipe, such that under freezing atmospheric temperature conditions, low pressure air is flowed through said steam riser pipe to said steam injection means when said gas flow rate is low; and steam under substantial pressure is flowed through said steam riser pipe to said steam injection means, when said gas flow rate is high, and whereby when said steam valve is open said air valve is closed, and vice versa; and (d) said control means responsive to said flow rate of waste gas, to open said steam valve whenever waste gases are being flared at said high flow rate.

2. The apparatus as in claim 1 including a manual shut-off valve in series with said air valve.

3. The apparatus as in claim 1 including bypass means around said steam valve, with shut-off means in said bypass means.

4. The apparatus as in claim 3 including orifice means in said bypass means.

5. The apparatus as in claim 1 including control means to shut down said blower when said air valve is closed.

6. The apparatus as in claim 1, and closely upstream of said steam valve, means for removal of water in liquid phase in said steam line means.

7. In a flare stack system in which waste gas is flared on demand, and in which the flow rate of waste gas may vary from a low flow rate to a high flow rate of 100% of the design value of gas flow rate; and including steam injection means at the top of said flare stack comprising manifold means connected to a steam riser pipe, and plural injection nozzles connected to said manifold; and wherein;

under freezing atmospheric temperature conditions low pressure air is flowed through said steam riser pipe to said steam injection means, when said gas flow rate is low, and steam under substantial pressure is flowed through said steam riser pipe to said steam injection means, when said gas flow rate is high;

the method comprising the steps of;

(a) providing a supply of low-pressure air;

(b) providing a supply of high-pressure steam;

(c) alternatively controlling the supply of low-pressure air, or high-pressure steam, to said steam riser pipe, responsive to the flow rate of said waste gases to said flare stack;

whereby, when said gas flow rate is high, steam at high pressure flows through said riser pipe, and said air valve is closed, and when said gas flow rate is low, said low-pressure air flows through said riser pipe, and said steam valve is closed.

8. The apparatus as in claim 1 wherein said control means is responsive to said atmospheric temperature.

9. The apparatus as in claim 1 wherein said control means is responsive to said flow of waste gas and said atmospheric temperature.

10. The apparatus as in claim 1 wherein said low flow rate is about 1% of the design value of gas flow rate.

11. The method as in claim 7 wherein said step of controlling said supply of low pressure air is responsive also to the atmospheric temperature.

* * * * *